US010480869B2

(12) United States Patent
Ishibashi et al.

(10) Patent No.: US 10,480,869 B2
(45) Date of Patent: Nov. 19, 2019

(54) HEAT EXCHANGER AND REFRIGERATION CYCLE APPARATUS INCLUDING THE SAME

(71) Applicant: Mitsubishi Electric Corporation, Tokyo (JP)

(72) Inventors: Akira Ishibashi, Tokyo (JP); Yuki Ugajin, Tokyo (JP); Daisuke Ito, Tokyo (JP); Shin Nakamura, Tokyo (JP); Satoshi Ueyama, Tokyo (JP); Aya Kawashima, Tokyo (JP); Susumu Yoshimura, Tokyo (JP); Takashi Matsumoto, Tokyo (JP); Ryota Akaiwa, Tokyo (JP); Yoji Onaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/753,185

(22) PCT Filed: Sep. 30, 2015

(86) PCT No.: PCT/JP2015/077788
§ 371 (c)(1),
(2) Date: Feb. 16, 2018

(87) PCT Pub. No.: WO2017/056250
PCT Pub. Date: Apr. 6, 2017

(65) Prior Publication Data

US 2018/0238637 A1 Aug. 23, 2018

(51) Int. Cl.
*F28F 1/04* (2006.01)
*F25B 39/00* (2006.01)
(Continued)

(52) U.S. Cl.
CPC ..... *F28F 1/04* (2013.01); *F25B 39/00* (2013.01); *F28D 7/0066* (2013.01); *F28F 9/02* (2013.01)

(58) Field of Classification Search
CPC ..... F28F 1/04; F28F 1/106; F28F 9/02; F28F 1/02; F28F 1/022; F28F 1/06;
(Continued)

(56) References Cited

U.S. PATENT DOCUMENTS 3,835,923 A * 9/1974 Platell ..... F28B 1/06 165/175
4,836,276 A * 6/1989 Yamanaka ..... F01M 5/002 123/41.33
(Continued)

FOREIGN PATENT DOCUMENTS

JP H05-099454 A 4/1993
JP 2001-201077 A 7/2001
(Continued)

OTHER PUBLICATIONS

International Search Report of the International Searching Authority dated Dec. 28, 2015 for the corresponding international application No. PCT/JP2015/077788 (and English translation).

*Primary Examiner* — Tho V Duong
*Assistant Examiner* — Raheena R Malik
(74) *Attorney, Agent, or Firm* — Posz Law Group, PLC

(57) ABSTRACT

A heat exchanger includes a first heat exchanging portion including first and second flat tubes stacked in parallel with each other and spaced from each other to allow fluid to pass between the first and second flat tubes, and a second heat exchanging portion including third and fourth flat tubes stacked in parallel with each other, spaced from each other to allow fluid to pass between the third and fourth flat tubes, and oriented crosswise to a direction in which the first and second flat tubes are oriented. The second heat exchanging
(Continued)

portion is arranged downstream of the first heat exchanging portion with respect to flow of the fluid.

8 Claims, 6 Drawing Sheets

(51) Int. Cl.
*F28D 7/00* (2006.01)
*F28F 9/02* (2006.01)

(58) Field of Classification Search
CPC .. F28F 2210/08; F25B 39/00; F28D 1/05383; F28D 7/0066; F28D 2021/0068; F28D 7/0058; F28D 7/1661
USPC ..... 165/175, 176
See application file for complete search history.

(56) References Cited

U.S. PATENT DOCUMENTS 5,236,336 A * 8/1993 Hitoshi ..... F28D 1/05383 165/153
6,988,538 B2 * 1/2006 Merkys ..... F25B 39/04 165/122
7,036,568 B2 * 5/2006 Yamauchi ..... F28D 1/0316 165/148
7,293,604 B2 * 11/2007 Sasaki ..... F28D 7/0025 165/164
2004/0069472 A1 * 4/2004 Shimoya ..... F28D 1/0316 165/165
2007/0256823 A1 * 11/2007 Molt ..... F28D 1/0535 165/175
2008/0092587 A1 4/2008 Gorbounov et al.
2010/0006276 A1 * 1/2010 Cremaschi ..... B21D 53/085 165/175
2010/0012307 A1 * 1/2010 Taras ..... F28D 1/0471 165/177
2011/0094257 A1 * 4/2011 Rusignuolo ..... F28D 1/0443 62/498

FOREIGN PATENT DOCUMENTS

JP 2006-284123 A 10/2006
JP 2007-187381 A 7/2007
JP 2008-528943 A 7/2008

* cited by examiner (a)

(b)

HEAT EXCHANGER AND REFRIGERATION CYCLE APPARATUS INCLUDING THE SAME

CROSS REFERENCE TO RELATED APPLICATION

This application is a U.S. national stage application of International Application No. PCT/JP2015/077788, filed on Sep. 30, 2015, the contents of which are incorporated herein by reference.

TECHNICAL FIELD

The present invention relates to a heat exchanger and a refrigeration cycle apparatus including the heat exchanger.

BACKGROUND

The total surface area of refrigerant flow paths formed in a heat exchange pipe of a heat exchanger can be increased in a manner in which the diameter of each refrigerant flow path formed is decreased and the number of the refrigerant flow paths is increased in accordance with the decrease in the diameter. The decrease in the diameter of each refrigerant flow path enables the heat exchange performance of the heat exchanger to be improved, and the heat exchanger can have a certain level of heat exchange performance even when the heat exchanger includes no fins (finless heat exchanger). Since the finless heat exchanger includes no fins, the heat exchanger can be compact.

A finless heat exchanger including flat heat exchange pipes (heat exchanging portions) defining refrigerant flow paths, an entrance-side header to which an end of each heat exchange pipe is connected, and an exit-side header to which the other end of each heat exchange pipe is connected has been proposed as an existing finless heat exchanger (see, for example, Patent Literature 1). In the heat exchanger disclosed in Patent Literature 1, the flat heat exchange pipes are connected to the entrance-side header and the exit-side header so as to be arranged in the longitudinal direction of the entrance-side header and the exit-side header.

PATENT LITERATURE

Patent Literature 1: Japanese Unexamined Patent Application Publication No. 2008-528943

The heat exchange performance of the finless heat exchanger is improved, for example, in a manner in which distances between the adjacent heat exchanging portions are decreased and the number of the heat exchange pipes is increased accordingly. Air passes through spaces formed between the adjacent heat exchange pipes. In this manner, however, the size of each of the spaces is decreased, and the spaces are likely to be filled. When the spaces are filled, air is unlikely to pass therethrough, and the heat exchange performance is impaired.

For example, in winter, when the heat exchanger functions as an evaporator, frost formation occurs between the heat exchange pipes in some cases. In the case where the distances between the heat exchange pipes are short, the spaces between the adjacent heat exchange pipes are likely to be filled with frost.

SUMMARY

The present invention has been accomplished to solve the above problems, and it is an object of the present invention to provide a heat exchanger that enables the heat exchange performance to be improved even when distances between flat tubes of the heat exchanging portions are not decreased, and a refrigeration cycle apparatus including the heat exchanger.

A heat exchanger according to an embodiment of the present invention includes a first heat exchanging portion including first and second flat tubes stacked in parallel with each other to allow fluid to pass between the first and second flat tubes; and a second heat exchanging portion including third and fourth flat tubes stacked in parallel with each other to allow fluid to pass between the third and fourth flat tubes, the third flat tube of the second heat exchanging portion being oriented crosswise to the first flat tube of the first heat exchanging portion in a cross-section perpendicular to a longitudinal direction of the third flat tube, the fourth flat tube of the second heat exchanging portion being oriented crosswise to the second flat tube of the first heat exchanging portion in a cross-section perpendicular to a longitudinal direction of the fourth flat tube.

The heat exchanger according to an embodiment of the present invention, which has the above structure, enables the heat exchange performance to be improved even when the distances in the heat exchanging portions are not decreased.

DETAILED DESCRIPTION

Embodiment of the present invention will hereinafter be described with reference to the drawings.

Embodiment

Figure 1:
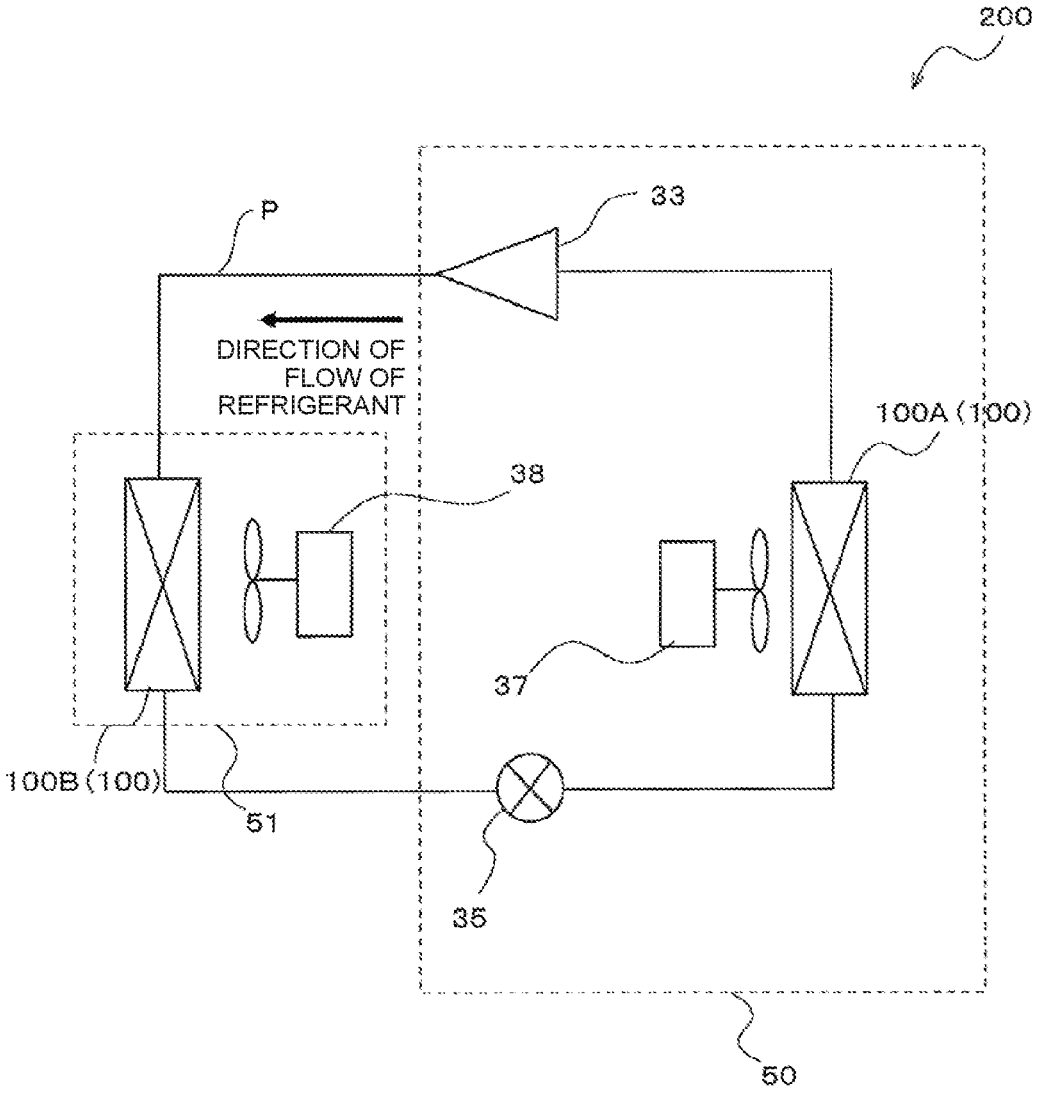
FIG. 1 is an explanatory diagram illustrating the structure of a refrigerant circuit or other structures of a refrigeration cycle apparatus 200 including a heat exchanger 100 according to Embodiment of the present invention.

FIG. 1 is an explanatory diagram illustrating the structure of a refrigerant circuit or other structures of a refrigeration cycle apparatus 200 including a heat exchanger 100 according to Embodiment. The structure and other features of the refrigeration cycle apparatus 200 will be described with reference to FIG. 1.

The heat exchanger 100 according to Embodiment has been improved upon to enable the heat exchange performance to be improved even when distances between flat tubes 1*a* of heat exchanging portions 1A are not decreased.

[Description of Structure of Refrigeration Cycle Device 200]

The refrigeration cycle apparatus 200 includes an outdoor unit 50 and an indoor unit 51, for example, in the case where the refrigeration cycle apparatus 200 is an air-conditioning device. The outdoor unit 50 and the indoor unit 51 are connected to each other with refrigerant pipes P interposed therebetween.

The outdoor unit 50 includes a compressor 33 that compresses refrigerant, an outdoor fan 37 that sends air and that supplies the air to the outdoor heat exchanger 100A, an outdoor heat exchanger 100A that functions as an evaporator, and an expansion device 35 that is connected to an indoor heat exchanger 100B described later and the outdoor heat exchanger 100A.

The indoor unit 51 includes the indoor heat exchanger 100B that functions as a condenser (radiator) and an indoor fan 38 that supplies air to the indoor heat exchanger 100B. In the following description, the outdoor heat exchanger 100A and the indoor heat exchanger 100B are each referred to as the heat exchanger 100 in some cases.

The compressor 33 compresses and discharges the refrigerant. The compressor 33 is connected to the indoor heat exchanger 100B on a refrigerant discharge side and is connected to the outdoor heat exchanger 100A on a refrigerant suction side. Various types of compressors such as a scroll compressor and a rotary compressor can be used as the compressor 33.

The heat exchanger 100 includes flat tubes defining refrigerant flow paths through which the refrigerant flows. The heat exchanger 100 does not include fins connected perpendicularly to the flat tubes. That is, the heat exchanger 100 is a so-called finless heat exchanger. The indoor heat exchanger 100B is connected on one side to the discharge side of the compressor 33 and is connected on the other side to the expansion device 35. The outdoor heat exchanger 100A is connected on one side to the suction side of the compressor 33 and is connected on the other side to the expansion device 35. The structure and other features of the heat exchanger 100 will be described later with reference to FIG. 2.

The indoor fan 38 forcibly draws air into the indoor unit 51 to supply the air to the indoor heat exchanger 100B. The indoor fan 38 is used for heat exchange between the drawn air and the refrigerant passing through the indoor heat exchanger 100B. The indoor fan 38 is installed in the indoor heat exchanger 100B.

The outdoor fan 37 forcibly draws air into the outdoor unit 50 to supply the air to the outdoor heat exchanger 100A. The outdoor fan 37 is used for heat exchange between the drawn air and the refrigerant passing through the outdoor heat exchanger 100A. The outdoor fan 37 is installed in the outdoor heat exchanger 100A. The indoor fan 38 and the outdoor fan 37 can each include, for example, an electric motor to which a shaft is connected, a boss that is rotated by the electric motor, and blades that are connected to an outer circumferential portion of the boss.

The expansion device 35 is used to decompress the refrigerant. The expansion device 35 may be, for example, a capillary tube, or an electronic expansion valve that can control an opening degree.

[Description of Operation of Refrigeration Cycle Device 200]

A gas refrigerant compressed and discharged by the compressor 33 enters the indoor heat exchanger 100B. The gas refrigerant that has entered the indoor heat exchanger 100B exchanges heat with the air supplied from the indoor fan 38, is condensed, and exits the indoor heat exchanger 100B. The refrigerant that has exited the indoor heat exchanger 100B enters the expansion device 35, is expanded by the expansion device 35, and is decompressed. The decompressed refrigerant enters the outdoor heat exchanger 100A, exchanges heat with outdoor air supplied from the outdoor fan 37, is vaporized, and exits the outdoor heat exchanger 100A. The refrigerant that has exited the outdoor heat exchanger 100A is sucked into the compressor 33.

[Heat Exchanger 100]

Figure 2:
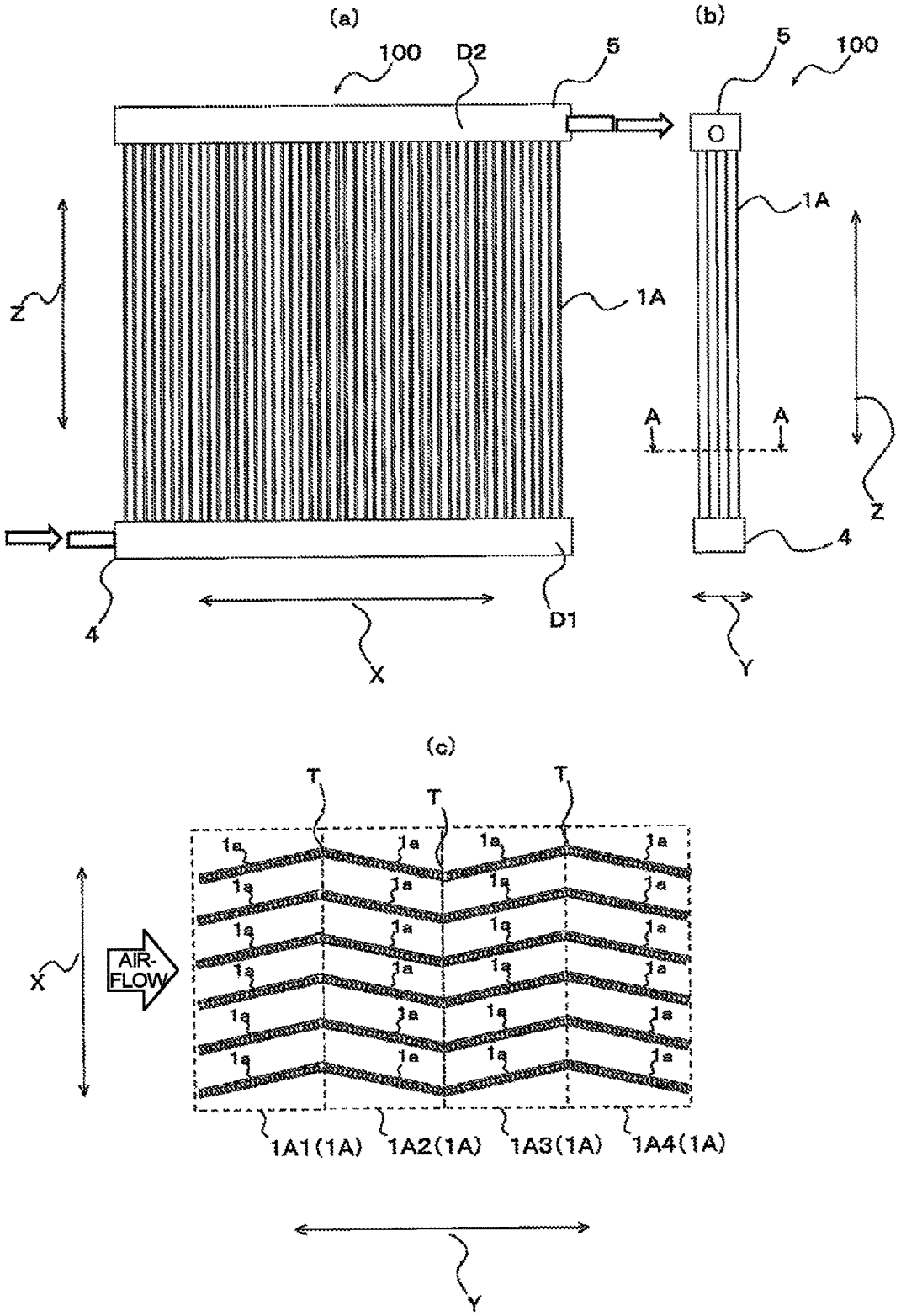
FIG. 2 illustrates explanatory diagrams of the heat exchanger 100 according to Embodiment of the present invention.

FIG. 2 illustrates explanatory diagrams of the heat exchanger 100 according to Embodiment.

FIG. 2(*a*) is a front view of the heat exchanger 100. FIG. 2(*b*) is a side view of the heat exchanger 100. FIG. 2(*c*) is a sectional view of the heat exchanging portions 1A in FIG. 2(*b*) taken along line A-A. In FIG. 2(*c*), the reduced scale of the width of each heat exchanging portion 1A in the Y-direction illustrated in FIG. 2(*b*) is increased for convenience of description.

Figure 3:
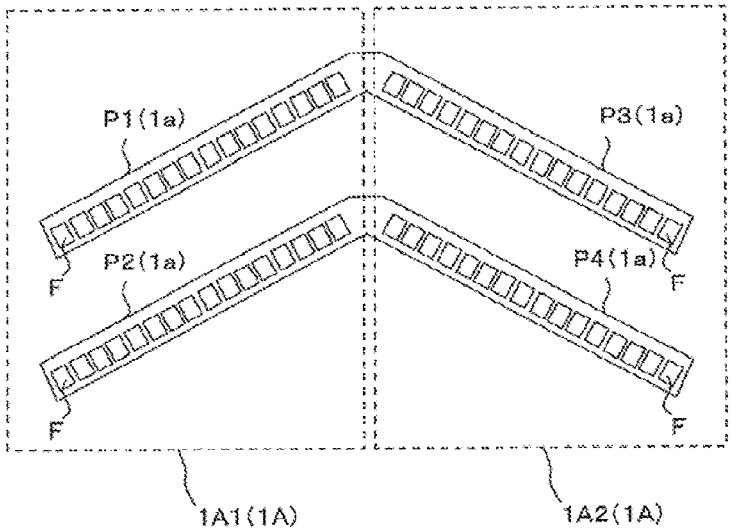
FIG. 3 illustrates explanatory diagrams of, for example, components of heat exchanging portions 1A of the heat exchanger 100 according to Embodiment of the present invention.
Figure 3:
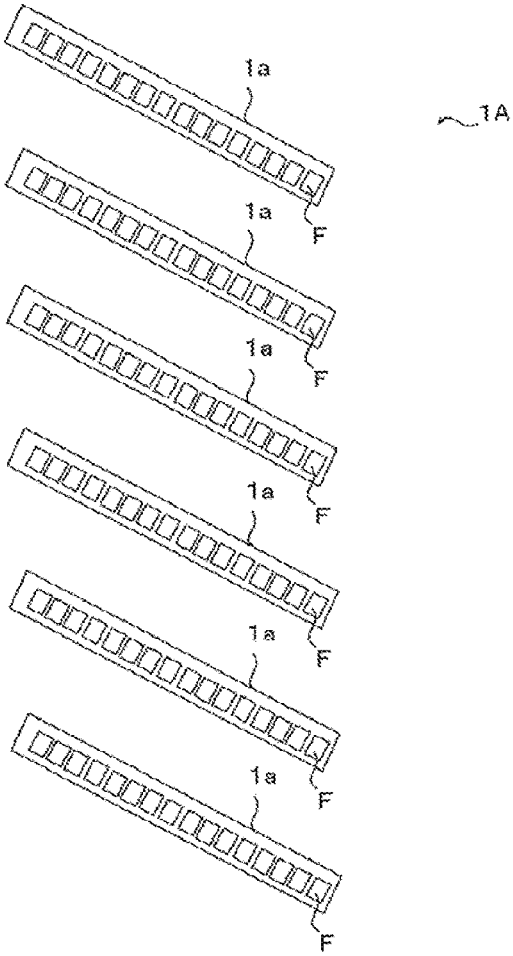

FIG. 3 illustrates explanatory diagrams of, for example, components of the heat exchanging portions 1A of the heat exchanger 100 according to Embodiment.

FIG. 3(*a*) illustrates adjacent flat tubes 1*a* of a heat exchanging portion 1A1 and adjacent flat tubes 1*a* of a heat exchanging portion 1A2 that correspond to the flat tubes 1*a* of the heat exchanging portion 1A1. According to Embodiment, as illustrated in FIG. 3(*a*), four flat tubes 1*a* represent a minimum configuration of the heat exchanger 100. FIG. 3(*a*) illustrates two flat tubes 1*a* of the heat exchanging portion 1A1, and an illustration of the other four flat tubes 1*a* of the heat exchanging portion 1A1 is omitted. Likewise, in the case of the heat exchanging portion 1A2, an illustration of the other four flat tubes 1*a* of the heat exchanging portion 1A2 is omitted.

FIG. 3(*b*) is an enlarged view of one of the heat exchanging portions 1A illustrated in FIG. 2(*c*). The structure of the heat exchanger 100 will be described with reference to FIG. 2 and FIG. 3.

The X-direction in FIG. 2 corresponds to a direction in which the flat tubes 1*a* are arranged. The Y-direction corresponds to a direction in which air passes. The Z-direction corresponds to the longitudinal direction of each flat tubes 1*a*. In the heat exchanger 100 according to Embodiment described by way of example, the X-direction in which the flat tubes 1*a* of the heat exchanging portions are arranged and the Y-direction in which the air passes are perpendicular to the Z-direction corresponding to the longitudinal direction of each flat tubes 1*a*. According to Embodiment described by way of example, the X-direction is perpendicular to the Y-direction. According to Embodiment described by way of example, the heat exchanger 100 is installed in the refrigeration cycle apparatus 200 such that the X-direction and the Y-direction are parallel with a horizontal plane, and the Z-direction is parallel with the gravity direction.

As illustrated in FIG. 3(*a*), the four flat tubes 1*a* represent the minimum configuration of the heat exchanger 100. That is, the heat exchanger 100 includes the heat exchanging portion 1A1 including two flat tubes 1*a* (corresponding to a first flat tube P1 and a second flat tube P2) that are stacked in parallel with each other, and the heat exchanging portion 1A2 including two flat tubes 1*a* (corresponding to a third flat tube P3 and a fourth flat tube P4) that are stacked in parallel with each other. The first flat tube P1 and the third flat tube P3 are connected to each other. The second flat tube P2 and the fourth flat tube P4 are connected to each other.

The first flat tube P1 and the third flat tube P3 have a correlation therebetween in the Y-direction. The second flat tube P2 and the fourth flat tube P4 have a correlation therebetween in the Y-direction. The first flat tube P1 and the second flat tube P2 have a correlation therebetween in the X-direction. The third flat tube P3 and the fourth flat tube P4 have a correlation therebetween in the X-direction.

The first flat tube P1, the second flat tube P2, the third flat tube P3, and the fourth flat tube P4 are described herein to describe the minimum configuration. The first flat tube P1, the second flat tube P2, the third flat tube P3, and the fourth flat tube P4 correspond to the flat tubes 1*a* in, for example, FIG. 2.

The heat exchanger 100 includes a first header 4 defining a fluid flow path D1 through which fluid flows, a second header 5 that defines a fluid flow path D2 through which fluid flows and that is paired with the first header 4, and the heat exchanging portions 1A including the flat tubes 1*a* each defining fluid flow paths F. According to Embodiment, the heat exchanging portions 1A represent the heat exchanging portion 1A1, the heat exchanging portion 1A2, a heat exchanging portion 1A3, and a heat exchanging portion 1A4.

The heat exchanger 100 is formed such that protruding portions (bulges) and recessed portions (depressions) alternate when viewed in a cross-section perpendicular to the fluid flow paths F. The protruding portions when viewed from a surface side are recessed portions when viewed from the other surface side.

The first header 4 is an elongated tubular member extending in the X-direction and defines the fluid flow path D1 through which fluid flows. The lower end of each heat exchanging portion 1A is connected to the first header 4. As illustrated in FIG. 2, the first header 4 is an inflow-side header that fluid supplied from, for example, the compressor 33 enters. The first header 4 is oriented, for example, in parallel with the horizontal direction.

The second header 5 is an elongated tubular member extending in the X-direction and defines the fluid flow path D2 through which fluid flows. The upper end of each heat exchanging portion 1A is connected to the second header 5. As illustrated in FIG. 2, the second header 5 is an outflow-side header to which the fluid that has passed through the first header 4 and the heat exchanging portions 1A is supplied. The second header 5 is oriented, for example, in parallel with the horizontal direction.

In each heat exchanging portion 1A, the flat tubes 1*a* are stacked in parallel with each other, and fluid (air) passes between the adjacent flat tubes 1*a*. In each heat exchanging portion 1A, six flat tubes 1*a* are arranged in the X-direction. Each heat exchanging portion 1A is connected at an end thereof to the first header 4 and is connected at the other end thereof to the second header 5. According to Embodiment, the heat exchanger 100 is vertically oriented in the outdoor unit 50. For this reason, the lower end of the heat exchanger 100 is connected to the first header 4, and the upper end thereof is connected to the second header 5. As illustrated in FIG. 2(*a*) and FIG. 2(*c*), in the heat exchanger 100, the heat exchanging portions 1A are arranged in the Y-direction. That is, the heat exchanging portion 1A1 is arranged on the most upstream side in the direction of airflow, the heat exchanging portion 1A2 is arranged downstream of the heat exchanging portion 1A1 in the direction of airflow, the heat exchanging portion 1A3 is arranged downstream of the heat exchanging portion 1A2 in the direction of airflow, and the heat exchanging portion 1A4 is arranged downstream of the heat exchanging portion 1A3 in the direction of airflow.

As illustrated in FIG. 3, each flat tube 1*a* of the heat exchanging portions 1A defines the fluid flow paths F through which fluid flows. The flat tubes 1*a* of one of the heat exchanging portions 1A are oriented crosswise in the direction in which the flat tubes 1*a* of the other heat exchanging portion 1A are oriented. The flat tubes 1*a* of one of the heat exchanging portions and the flat tubes 1*a* of the other heat exchanging portion represent the flat tubes 1*a* of the adjacent heat exchanging portions 1A. For example, the heat exchanging portion 1A1 is the one of the heat exchanging portions 1A, and the heat exchanging portion 1A2 is the other heat exchanging portion 1A.

The flat tubes 1*a* oriented crosswise will now be described. The flat tubes 1*a* of the heat exchanging portion 1A2 adjacent to the heat exchanging portion 1A1 are oriented crosswise in the direction in which the corresponding flat tubes 1*a* of the heat exchanging portion 1A1 are oriented. Specifically, the transverse direction of each flat tube 1*a* of the heat exchanging portion 1A1 is parallel with the direction in which the fluid flow paths F are arranged, and the transverse direction of each flat tube 1*a* of the heat exchanging portion 1A1 intersects the transverse direction of each flat tube 1*a* of the heat exchanging portion 1A2. Because of the intersection, the transverse direction of each flat tube 1*a* of the heat exchanging portion 1A1 is not parallel with the transverse direction of each flat tube 1*a* of the heat exchanging portion 1A2.

The same structure as the above structure of the heat exchanging portion 1A1 and the heat exchanging portion 1A2 can be described in the case of the heat exchanging portion 1A2 and the heat exchanging portion 1A3 and in the case of the heat exchanging portion 1A3 and the heat exchanging portion 1A4. That is, the flat tubes 1*a* of one of the adjacent heat exchanging portions 1A are oriented crosswise in the direction in which the flat tubes 1*a* of the other heat exchanging portion 1A are oriented.

According to Embodiment, the transverse direction of each flat tube 1*a* of the heat exchanging portion 1A1 is parallel with the transverse direction of each flat tube 1*a* of the heat exchanging portion 1A3, and the transverse direction of each flat tube 1*a* of the heat exchanging portion 1A2 is parallel with the transverse direction of each flat tube 1*a* of the heat exchanging portion 1A4.

The adjacent flat tubes 1*a* are coupled with each other to integrally form the heat exchanging portions 1A.

In FIG. 3(*a*), the first flat tube P1 and the third flat tube P3 are connected to (coupled with) each other, and the second flat tube P2 and the fourth flat tube P4 are connected to (coupled with) each other.

In FIG. 2(*c*), downstream end portions of the flat tubes 1*a* of the heat exchanging portion 1A1 of the heat exchanger 100 according to Embodiment are connected to (coupled with) upstream end portions of the flat tubes 1*a* of the heat exchanging portion 1A2. Likewise, downstream end portions of the flat tubes 1*a* of the heat exchanging portion 1A2 are connected to (coupled with) upstream end portions of the flat tubes 1*a* of the heat exchanging portion 1A3, and downstream end portions of the flat tubes 1*a* of the heat exchanging portion 1A3 are connected to (coupled with) upstream end portions of the flat tubes 1*a* of the heat exchanging portion 1A4.

When the heat exchanger 100 is viewed in a cross-section perpendicular to the fluid flow paths F, bent portions of the heat exchanger 100 correspond to parts of the heat exchanging portions 1A that intersect each other. In other words, the flat tubes 1*a* of the adjacent heat exchanging portions 1A correspond to the connected portions. The parts of the heat exchanging portions 1A that intersect each other correspond to tip portions T of the heat exchanger 100. As illustrated in FIG. 2(*c*), the heat exchanger 100 includes the four heat exchanging portions 1A, and each heat exchanging portion 1A includes the six flat tubes 1*a*. For this reason, the heat exchanger 100 includes 24 (4×6=24) tip portions T.

[Effects of Heat Exchanger 100 according to Embodiment]

The heat exchanger 100 according to Embodiment includes a first heat exchanging portion including the first and second flat tubes P1 and P2 stacked in parallel with each other and spaced from each other to allow fluid to pass between the first and second flat tubes P1 and P2, and a second heat exchanging portion including the third and fourth flat tubes P3 and P4 stacked in parallel with each other, spaced from each other to allow fluid to pass between the third and fourth flat tubes P3 and P4, and oriented crosswise to the direction in which the first and second flat tubes P1 and P2 are oriented. The second heat exchanging portion is arranged downstream of the first heat exchanging portion with respect to flow of the fluid.

The first heat exchanging portion and the second heat exchanging portion represent the adjacent heat exchanging portions. That is, the first heat exchanging portion and the second heat exchanging portion represent the heat exchanging portion 1A1 and the heat exchanging portion 1A2. Moreover, the first heat exchanging portion and the second heat exchanging portion represent the heat exchanging portion 1A2 and the heat exchanging portion 1A3. Furthermore, the first heat exchanging portion and the second heat exchanging portion represent the heat exchanging portion 1A3 and the heat exchanging portion 1A4.

Since the heat exchanger 100 according to Embodiment includes the first heat exchanging portion and the second heat exchanging portion as above, the area of heat exchange between the fluid flowing through the heat exchanging portions 1A and the air passing through the heat exchanging portions 1A can be larger than that in a heat exchanger including a single heat exchanging portion.

The air flowing through the heat exchanger 100 meanders while passing through the flat tubes 1*a* of the heat exchanging portions 1A, and is agitated while passing through the heat exchanging portions 1A. This improves a heat transfer coefficient.

The heat exchanger 100 according to Embodiment has an increased area of heat exchange and an improved heat transfer coefficient as above and thus enables the heat exchange performance to be improved without a measure of, for example, decreasing the distances between the flat tubes 1*a* of each heat exchanging portion 1A that are adjacent to each other in the X-direction.

Figure 7:
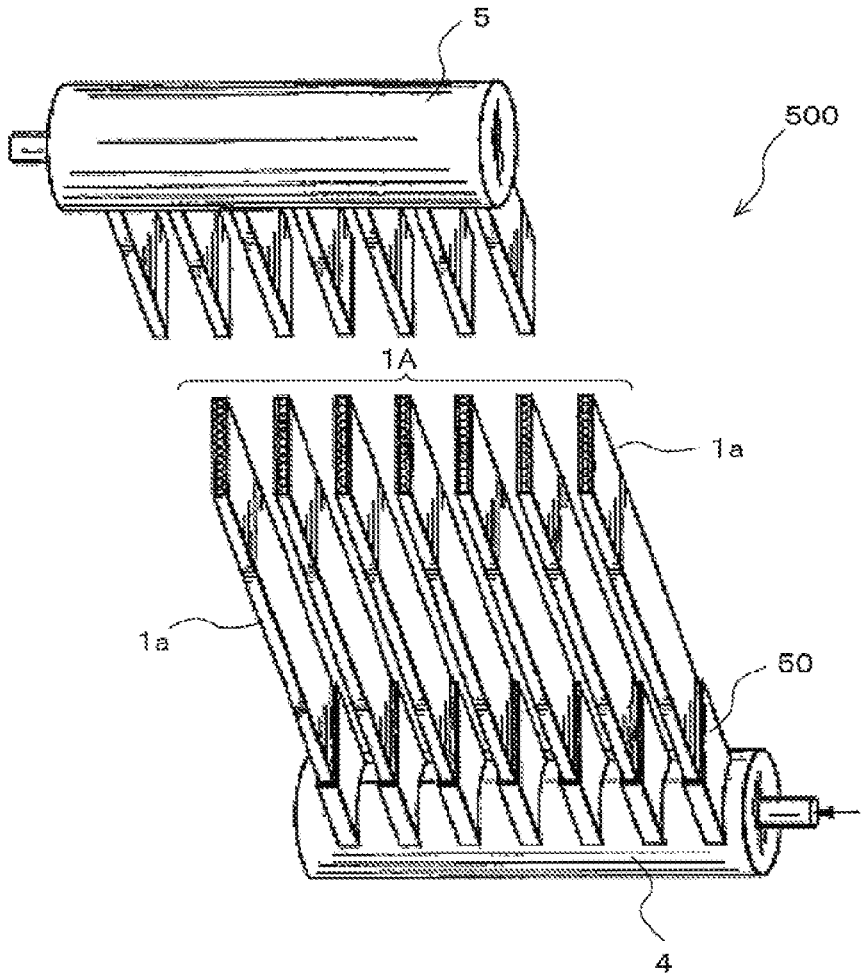
FIG. 7 PRIOR ART
FIG. 7 is a perspective view of an existing heat exchanger.

FIG. 7 is a perspective view of an existing heat exchanger. As illustrated in FIG. 7, an existing heat exchanger 500 includes a single heat exchanging portion 1A. Fluid flow paths are formed in the heat exchanging portion 1A to improve the heat exchange performance. However, the distances between the flat tubes 1*a* included in the heat exchanging portion 1A need to be decreased to further improve the heat exchange performance. As the distances between the flat tubes 1*a* of the heat exchanging portion 1A decrease, air is more unlikely to pass due to frost formation, and there is a possibility that the accuracy of assembly that is required in manufacturing increases and the manufacturing cost increases. The heat exchanger 100 according to Embodiment can avoid these disadvantages.

In the refrigeration cycle apparatus 200 including the heat exchanger 100 according to Embodiment, the second header 5 on the side on which the fluid exits is disposed above the first header 4 on the side on which the fluid enters. The heat exchanging portions 1A are oriented in parallel with the gravity direction. For this reason, the fluid supplied to the heat exchanger 100 moves from the lower side to the upper side, the distribution of the fluid to the heat exchanging portions 1A is likely to be uniform, and the heat exchange performance is improved. For example, in the case where the first header 4 is a header on the side on which the fluid enters and the second header 5 is a header on the side on which the fluid exits, the fluid flows down preferentially from the flat tube 1*a* near a fluid inlet of the first header 4 but is unlikely to flow to the flat tube 1*a* far from the fluid inlet. Thus, the distribution of the fluid to the heat exchanging portions 1A is non-uniform, and there is a possibility that the heat exchange performance is impaired. The refrigeration cycle apparatus 200 including the heat exchanger 100 according to Embodiment avoids these disadvantages, and the heat exchange performance is improved.

The heat exchanger 100 according to Embodiment is a finless heat exchanger that does not include fins connected perpendicularly to the heat exchanging portions 1A (heat exchange pipes). A heat exchanger including fins has thermal contact resistance between the heat exchange pipes and the fins and the resistance of the fins due to heat conduction. However, since the heat exchanger 100 according to Embodiment is the finless heat exchanger, which does not have the above thermal contact resistance between the heat exchange pipes and the fins and the resistance of the fins due to heat conduction, the heat exchange performance is improved.

In the case where the heat exchanger 100 is used as the evaporator, condensed water flows down along the heat exchanging portions 1A oriented in parallel with the gravity direction. The heat exchanger 100 according to Embodiment can thus increase a drainage capacity. The heat exchanger 100 has an increased drainage capacity and can inhibit an ice layer to be formed on a lower portion of the heat exchanger 100, for example, during defrosting operation.

The adjacent heat exchanging portions 1A of the heat exchanger 100 according to Embodiment are arranged such that the transverse directions of the flat tubes 1*a* intersect each other, and the strength thereof increases accordingly. In the heat exchanger 100, the second header 5 is disposed on the upper side of the heat exchanging portions 1A, and the weight of the second header 5 is applied to the heat exchanging portions 1A. However, since the adjacent heat exchanging portions 1A of the heat exchanger 100 according to Embodiment are oriented crosswise, buckling due to the weight of the second header, for example, can be avoided.

The refrigeration cycle apparatus 200 including the heat exchanger 100 according to Embodiment described by way of example is an air-conditioning device. The refrigeration cycle apparatus, however, is not limited thereto and may be, for example, a refrigerator.

In the refrigeration cycle apparatus 200 including the heat exchanger 100 according to Embodiment, a refrigerant such as R410A, R32, or HFO1234yf can be used as a working fluid.

In the refrigeration cycle apparatus 200 including the heat exchanger 100 according to Embodiment described by way of example, refrigerant is used as the fluid. The fluid, however, is not limited thereto and may be, for example, a fluid such as water or brine.

In the example described for the refrigeration cycle apparatus 200 including the heat exchanger 100 according to Embodiment, air and refrigerant are used as the fluid. That is, refrigerant is a first fluid, and air is a second fluid. The first fluid and the second fluid are not limited thereto and may be other gases, liquids, or gas-liquid mixture fluids.

In the refrigeration cycle apparatus 200 including the heat exchanger 100 according to Embodiment, any refrigerating machine oil such as mineral oil, alkylbenzene oil, ester oil, ether oil, and fluorinated oil can be used irrespective of the solubility of the oil in refrigerant.

The refrigeration cycle apparatus 200 including the heat exchanger 100 according to Embodiment includes no four-way valve and is used for heating only, but may include a four-way valve to switch cooling and heating.

In the example described according to Embodiment, the heat exchanger 100 is used as, but not limited to, the outdoor heat exchanger 100A and the indoor heat exchanger 100B. The same effects can be achieved even when the heat exchanger 100 is used as either the outdoor heat exchanger or the indoor heat exchanger. That is, the refrigeration cycle apparatus 200 including the heat exchanger 100 according to Embodiment has improved energy efficiency because of the heat exchanger 100. The energy efficiency is expressed as the following expressions:

heating energy efficiency=indoor heat exchanger 100B (condenser) capacity/total input, cooling energy efficiency=indoor heat exchanger 100B (evaporator) capacity/total input.

First Modification

Figure 4:
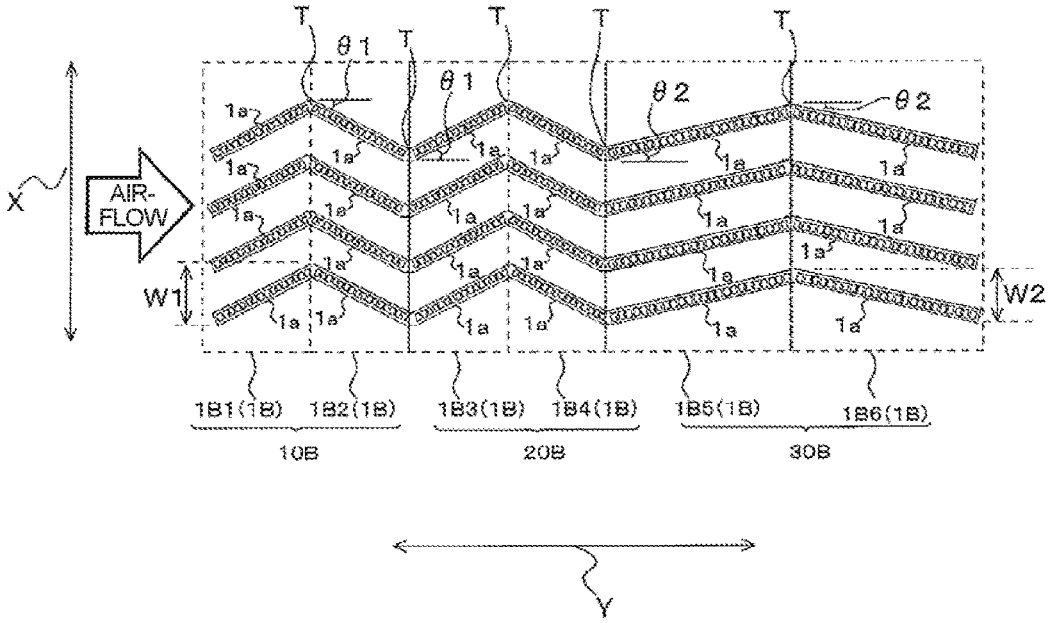
FIG. 4 illustrates a first modification to the heat exchanger 100 according to Embodiment of the present invention.

FIG. 4 illustrates a first modification to the heat exchanger 100 according to Embodiment. As illustrated in FIG. 4, angles at which the adjacent heat exchanging portions 1B are oriented crosswise may differ between the upstream side and the downstream side in the direction of airflow. The lengths of the flat tubes 1*a* in the transverse direction that are included in the heat exchanging portions 1B may differ from each other.

The heat exchanger 100 according to the first modification includes a plurality of heat exchanging bodies. According to the first modification, the heat exchanger 100 includes a heat exchanging body 10B, a heat exchanging body 20B, and a heat exchanging body 30B. The heat exchanging body 20B is arranged downstream of the heat exchanging body 10B in the direction of airflow. The heat exchanging body 30B is arranged downstream of the heat exchanging body 20B in the direction of airflow. The heat exchanging body 10B includes heat exchanging portions 1B. Specifically, the heat exchanging body 10B includes a heat exchanging portion 1B1 and a heat exchanging portion 1B2 according to the first modification.

The heat exchanging body 20B includes heat exchanging portions 1B and includes a heat exchanging portion 1B3 and a heat exchanging portion 1B4 according to the first modification.

The heat exchanging body 30B includes heat exchanging portions 1B and includes a heat exchanging portion 1B5 and a heat exchanging portion 1B6 according to the first modification.

The heat exchanging body 10B and the heat exchanging body 20B correspond to a first heat exchanging body and a second heat exchanging body. Likewise, the heat exchanging body 20B and the heat exchanging body 30B correspond to a first heat exchanging body and a second heat exchanging body. Likewise, the heat exchanging body 10B and the heat exchanging body 30B correspond to a first heat exchanging body and a second heat exchanging body.

The heat exchanger 100 according to the first modification includes, for example, the six heat exchanging portions 1B. The heat exchanger 100 according to the first modification includes tip portions T corresponding to parts of the heat exchanging portions 1B that intersect each other when viewed in a section perpendicular to the fluid flow paths F. The heat exchanger 100 according to the first modification includes the six heat exchanging portions 1B, and each heat exchanging portion 1B includes four flat tubes 1*a*. For this reason, the heat exchanger 100 according to the first modification includes 24 (4×6=24) tip portions T.

In the heat exchanger 100 according to the first modification, the lengths of the flat tubes 1*a* in the transverse direction that are included in the heat exchanging portions 1B located on the side (downstream side in the direction of airflow) on which air exits are larger than those in the heat exchanging portions 1B located on the side (upstream side in the direction of airflow) on which the air that exchanges heat with the fluid enters.

In the heat exchanger 100 according to the first modification, as illustrated in FIG. 4, angles formed between the Y-direction and the flat tubes 1*a* differ from each other. Specifically, the heat exchanging portion 1B1, the heat exchanging portion 1B2, the heat exchanging portion 1B3, and the heat exchanging portion 1B4 are nearer than the heat exchanging portion 1B5 and the heat exchanging portion 1B6 to the upstream side in the direction of airflow. Thus, the heat exchanging portion 1B1, the heat exchanging portion 1B2, the heat exchanging portion 1B3, and the heat exchanging portion 1B4 are referred to as upstream heat exchanging portions, and the heat exchanging portion 1B5 and the heat exchanging portion 1B6 are referred to as downstream heat exchanging portions. The upstream heat exchanging portions include the heat exchanging body 10B and the heat exchanging body 20B. The downstream heat exchanging portions include the heat exchanging body 30B.

According to the first modification, the angles formed between the Y-direction and the flat tubes 1*a* of the upstream heat exchanging portions are larger than the angles formed between the Y-direction and the flat tubes 1*a* of the downstream heat exchanging portions. In the following description, the angles formed between the Y-direction and the flat tubes 1*a* are also referred to simply as angles.

Since the angles θ1 formed between the Y-direction and the flat tubes 1*a* of the upstream heat exchanging portions are larger than the angles θ2 formed between the Y-direction and the flat tubes 1*a* of the downstream heat exchanging portions, the number of the tip portions T is increased accordingly, and the area of contact between each heat exchanging portion 1A and frost is increased. The reason is that in the heat exchanging portions 1B, frost formation is likely to occur particularly at upstream portions in the direction of airflow.

In the case where heating operation is performed, the heat exchanger 100 functions as the evaporator, and frost formation occurs in the heat exchanger 100, defrosting operation, in which the direction of the flow of the refrigerant through the refrigerant circuit is reversed to supply the heated refrigerant to the heat exchanger 100, enables frost attached on the heat exchanging portions 1B on the upstream side in the direction of airflow to be efficiently removed.

Since the angles θ2 formed between the Y-direction and the flat tubes 1*a* of the downstream heat exchanging portions are smaller than the angles θ1 formed between the Y-direction and the flat tubes 1*a* of the upstream heat exchanging portions, an increase in airflow resistance can be avoided. That is, in the case where the number of the heat exchanging portions 1B is increased, and the number of the tip portions T of the heat exchanger 100 is increased, the airflow resistance increases although the area of heat exchange can be increased. In view of this, in the heat exchanger 100 according to the first modification, the angles on the downstream side in the direction of airflow are made smaller to avoid the increase in the airflow resistance.

The heat exchanger 100 according to the first modification enables frost to be efficiently removed and enables an increase in the airflow resistance to be avoided as above.

In the heat exchanging portions 1B of the heat exchanger 100 according to the first modification, the distances between the adjacent flat tubes 1*a* of the heat exchanging portions 1B of the upstream heat exchanging portions are larger than the distances between the flat tubes 1*a* of the heat exchanging portions 1B of the downstream heat exchanging portions. For example, as illustrated in FIG. 4, the distances W1 in the heat exchanging portion 1B6 located on the side on which air enters are larger than the distances W2 in the heat exchanging portion 1B1 located on the side on which the air exits. This increases the area of contact between each heat exchanging portion 1B and frost on the upstream side in the direction of airflow, where frost is particularly likely to form, and enables the frost to be efficiently removed in the heat exchanger 100 according to the first modification.

Effects of First Modification

According to the first modification, in addition to the effects of the heat exchanger 100 according to Embodiment, the following effects are achieved. In the heat exchanger 100 according to the first modification, the lengths of the first flat tube P1 and the second flat tube P2 of the second heat exchanging body in the transverse direction are larger than the lengths of the first flat tube P1 and the second flat tube P2 of the first heat exchanging body, and the lengths of the third flat tube P3 and the fourth flat tube P4 of the second heat exchanging body in the transverse direction are larger than the lengths of the third flat tube P3 and the fourth flat tube P4 of the first heat exchanging body.

In addition, the angles formed between the Y-direction and the flat tubes 1*a* of the heat exchanging portions 1B on the upstream side in the direction of airflow are larger than the angles formed between the Y-direction and the flat tubes 1*a* of the heat exchanging portions 1B on the downstream side in the direction of airflow, and the number of the tip portions T is increased.

For these reasons, the heat exchanger 100 according to the first modification enables frost to be efficiently removed and enables an increase in the airflow resistance to be avoided.

In addition, in the heat exchanger 100 according to the first modification, the distances (intervals) between the adjacent flat tubes 1*a* of the heat exchanging portions 1B on the upstream side in the direction of airflow are larger than those in the heat exchanging portions 1B on the downstream side in the direction of airflow. For this reason, the area of contact between each heat exchanging portion 1B and frost can be increased, and the frost can be efficiently removed.

Second Modification

Figure 5:
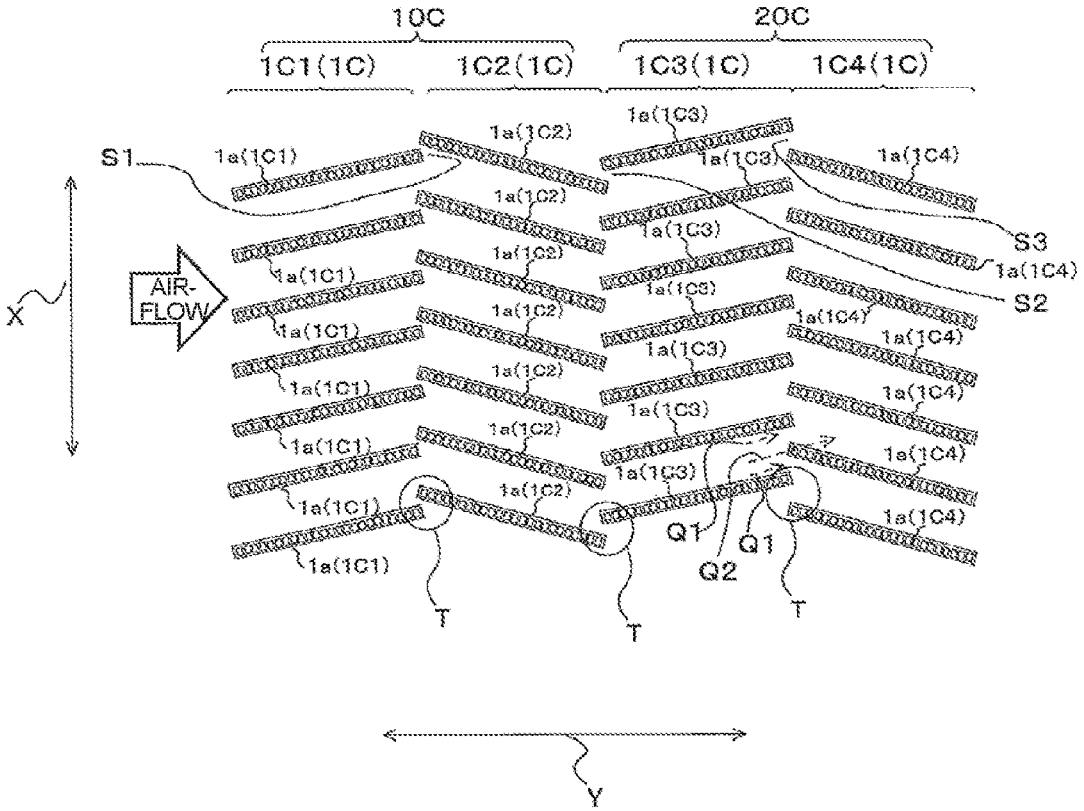
FIG. 5 illustrates a second modification to the heat exchanger 100 according to Embodiment of the present invention.

FIG. 5 illustrates a second modification to the heat exchanger 100 according to Embodiment. As illustrated in FIG. 5, adjacent heat exchanging portions 10 are not coupled with each other, and the heat exchanging portions 10 are separate from each other. That is, regarding the minimum configuration of the heat exchanger 100, the first flat tube P1 and the third flat tube P3 are separate from each other, and the second flat tube P2 and the fourth flat tube P4 are separate from each other. The second modification will now be described in detail.

The heat exchanger 100 according to the second modification includes heat exchanging bodies. According to the second modification, the heat exchanger 100 includes a first heat exchanging body 10C and a second heat exchanging body 20C. The second heat exchanging body 20C is arranged downstream of the first heat exchanging body 10C in the direction of airflow.

The first heat exchanging body 10C includes heat exchanging portions 1C and includes a heat exchanging portion 1C1 and a heat exchanging portion 1C2 according to the second modification.

The second heat exchanging body 20C includes heat exchanging portions 1C and includes a heat exchanging portion 1C3 and a heat exchanging portion 1C4 according to the second modification.

The heat exchanger 100 according to the second modification includes the (four) heat exchanging portions 1C that are separate from each other. Each heat exchanging portion 1C includes seven flat tubes 1*a* that are stacked in parallel with each other. The heat exchanger 100 according to the second modification includes the heat exchanging portion 1C1, the heat exchanging portion 1C2 arranged downstream of the heat exchanging portion 1C1 in the direction of airflow, the heat exchanging portion 1C3 arranged downstream of the heat exchanging portion 1C2 in the direction of airflow, and the heat exchanging portion 1C4 arranged downstream of the heat exchanging portion 1C3 in the direction of airflow.

The adjacent heat exchanging portions 1C are arranged at predetermined intervals. That is, the heat exchanging portions 1C are spaced from each other to allow air to pass therebetween. Specifically, the flat tubes 1*a* adjacent to each other in the Y-direction are arranged at predetermined intervals. That is, spaces S1 are formed between the flat tubes 1*a* of the heat exchanging portion 1C1 and the flat tubes 1*a* of the heat exchanging portion 1C2. Spaces S2 are formed between the flat tubes 1*a* of the heat exchanging portion 1C2 and the flat tubes 1*a* of the heat exchanging portion 1C3. Spaces S3 are formed between the flat tubes 1*a* of the heat exchanging portion 1C3 and the flat tubes 1*a* of the heat exchanging portion 1C4.

In the following description, the spaces S1, the spaces S2, and the spaces S3 are also referred to simply as spaces S.

For example, the spaces S1 are formed between the flat tubes 1*a* of the heat exchanging portion 1C1 and the flat tubes 1*a* of the heat exchanging portion 1C2 in the following manner. Upstream end portions of the flat tubes 1*a* of the heat exchanging portion 1C2 in the direction of airflow are shifted so as to cover downstream end portions of the flat tubes 1*a* of the heat exchanging portion 1C1. More specifically, the upstream end portions of the flat tubes 1*a* of the heat exchanging portion 1C2 in the direction of airflow are shifted in the X-direction based on the positions of the downstream end portions of the flat tubes 1*a* of the heat exchanging portion 1C1 and are shifted in a direction toward the flat tubes 1*a* of the heat exchanging portion 1C1. The direction toward the flat tubes 1*a* of the heat exchanging portion 1C1 is parallel with the Y-direction. The spaces S1 are thus formed between the end portions of the flat tubes 1*a* of the heat exchanging portion 1C1 and the end portions of the flat tubes 1*a* of the heat exchanging portion 1C2.

In the heat exchanger 100 according to the second modification, the heat exchanging portions 1C are arranged such that the spaces S located on the downstream side in the direction of airflow are larger than the spaces S located on the upstream side in the direction of airflow. That is, in the heat exchanger 100 according to the second modification, the heat exchanging portion 1C1, the heat exchanging portion 1C2, and the heat exchanging portion 1C3 are arranged such that the spaces S2 are larger than the spaces S1, and the heat exchanging portion 1C2, the heat exchanging portion 1C3, and the heat exchanging portion 1C4 are arranged such that the spaces S3 are larger than the spaces S2.

According to the second modification described by way of example, the relation of spaces S1<spaces S2<spaces S3 holds. The second modification, however, is not limited thereto. It is only necessary for the spaces on the side on which air enters to be larger than the spaces on the side on which the air exits, and, for example, the relation of spaces S1=spaces S2<spaces S3 is acceptable.

Effects of Second Modification

According to the second modification, in addition to the effects of the heat exchanger 100 according to Embodiment, the following effects are achieved. The heat exchanging bodies of the heat exchanger 100 according to the second modification include the first heat exchanging body 10C having the spaces S1, and the second heat exchanging body 20C that has the spaces S3 larger than the spaces S1 of the first heat exchanging body 10C and that is arranged downstream of the first heat exchanging body 10C in the direction of the flow of the fluid. The spaces S2 that are larger than the spaces S1 and smaller than the spaces S3 are formed between the first heat exchanging body 10C and the second heat exchanging body 20C. Thus, areas that the air to be drawn into the heat exchanger 100 enters can be increased, and the heat-exchange efficiency can be improved.

For example, in the case where the heat exchanger 100 functions as the condenser, the air that has entered the flat tubes 1*a* of the heat exchanging portion 1C1 exchanges heat with the fluid flowing through the flat tubes 1*a*, is heated, and exchanges heat with, for example, the fluid flowing through the flat tubes 1*a* of the heat exchanging portion 1C2 on the downstream side. That is, heat is exchanged between the heated air and the fluid flowing through the flat tubes 1*a* of the heat exchanging portion 1C2, and this results in a reduction in the heat-exchange efficiency. However, in the heat exchanger 100 according to the second modification, air that is not heated enters the flat tubes 1*a* of the heat exchanging portion 1C2 from the spaces S1, and this inhibits the heat-exchange efficiency from being reduced.

In the heat exchanger 100 according to the second modification, the spaces S3 are formed on the downstream side in the direction of airflow, and thus, the airflow resistance of the air passing through the heat exchanger 100 can be decreased.

The spaces S1 are formed in the heat exchanging portions 1C on the upstream side in the direction of airflow. In the case where the heat exchanger 100 functions as the evaporator, and frost formation occurs therein, the spaces S1 are likely to be blocked due to the frost. However, the spaces S3, which are larger than the spaces S1, are unlikely to be blocked. Consequently, the airflow resistance can be inhibited from increasing even when the heat exchanger 100 functions as the evaporator.

Regarding the flow velocity of the air passing through the heat exchanging portions 10, the velocity Q2 of the air flowing along a middle position between the adjacent heat exchanging portions 1C is higher than the velocity Q1 of the air flowing near each heat exchanging portion 1C. According to the second modification, the flat tubes 1*a* are arranged such that the spaces S, such as the spaces S1, are formed.

For example, in the case of the heat exchanging portion 1C3 and the heat exchanging portion 1C4, the upstream end portions of the flat tubes 1*a* of the heat exchanging portion 1C4 in the direction of airflow are located between the downstream end portions of the adjacent flat tubes 1*a* of the heat exchanging portion 1C3 in the direction of airflow.

The upstream end portions of the flat tubes 1*a* of the heat exchanging portion 1C4 in the direction of airflow are arranged at positions at which the flow velocity of the air is high, and the efficiency of heat-exchange between the air and the fluid flowing through the flat tubes 1*a* of the heat exchanging portion 1C4 is improved accordingly. The same is true for the relationship between the flat tubes 1*a* of the heat exchanging portion 1C1 and the flat tubes 1*a* of the heat exchanging portion 1C2, and for the relationship between the flat tubes 1*a* of the heat exchanging portion 1C2 and the flat tubes 1*a* of the heat exchanging portion 1C3, and likewise, the heat-exchange efficiency of the heat exchanger 100 is improved. The heat exchanger 100 according to the second modification thus enables the heat-exchange efficiency to be improved.

Third Modification

Figure 6:
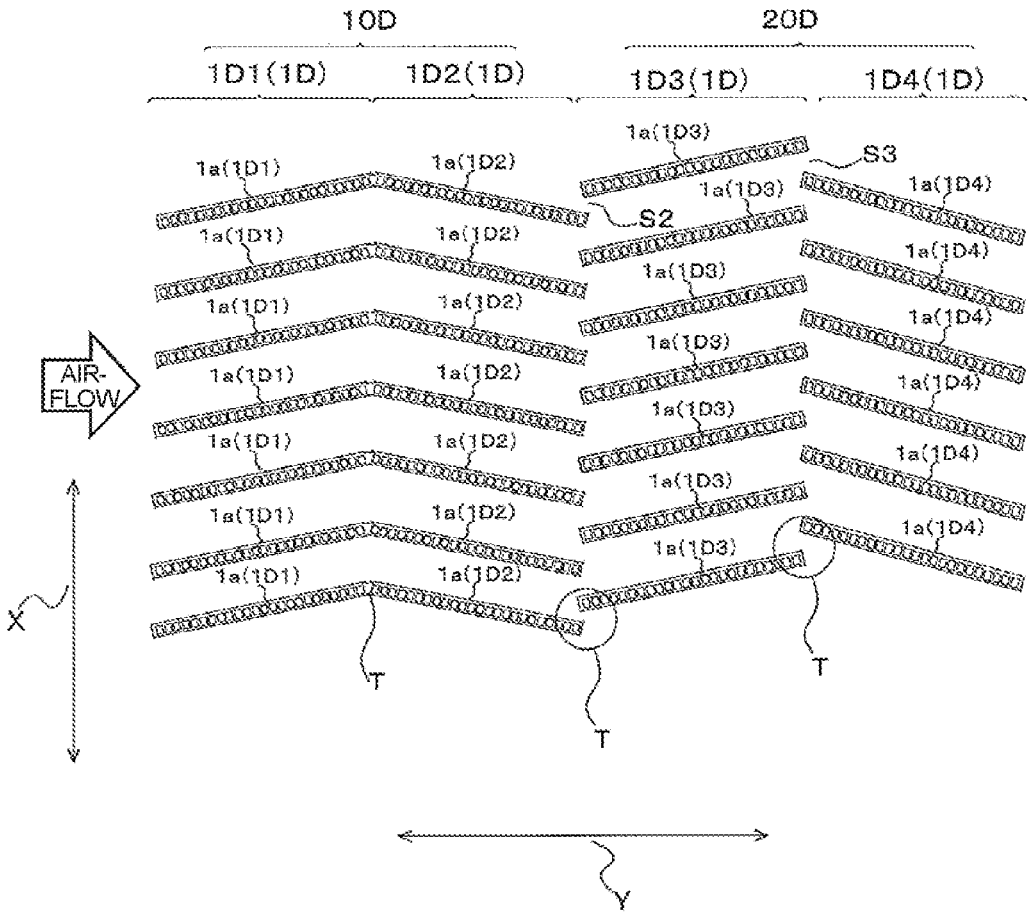
FIG. 6 illustrates a third modification to the heat exchanger 100 according to Embodiment of the present invention.

FIG. 6 illustrates a third modification to the heat exchanger 100 according to Embodiment. The third modification corresponds to a combination of Embodiment and the second modification.

The heat exchanger 100 according to the third modification includes heat exchanging bodies. According to the third modification, the heat exchanger 100 includes a first heat exchanging body 10D and a second heat exchanging body 20D.

The second heat exchanging body 20D is arranged downstream of the first heat exchanging body 10D in the direction of airflow.

The first heat exchanging body 10D includes heat exchanging portions 1D and includes a heat exchanging portion 1D1 and a heat exchanging portion 1D2 according to the third modification.

The second heat exchanging body 20D includes heat exchanging portions 1D and includes a heat exchanging portion 1D3 and a heat exchanging portion 1D4 according to the third modification.

The heat exchanger 100 according to the third modification includes the first heat exchanging body 10D that is integrally formed such that the heat exchanging portion 1D1 and the heat exchanging portion 1D2 are coupled with each other, and the second heat exchanging body 20D including the heat exchanging portion 1D3 and the heat exchanging portion 1D4. The heat exchanging portion 1D3 and the heat exchanging portion 1D4 are separate from each other. The first heat exchanging body 10D is integrally formed such that the flat tubes 1*a* adjacent to each other in the Y-direction are coupled with each other.

In the second heat exchanging body 20D, spaces S are formed between the flat tubes 1*a* adjacent to each other in the Y-direction. Specifically, spaces S2 are formed between the first heat exchanging body 10D and the second heat exchanging body 20D. Spaces S3 larger than the spaces S2 are formed between the flat tubes 1*a* of the second heat exchanging body 20D. That is, the heat exchanging portion 1D3 forming a part of the second heat exchanging body 20D is arranged such that the spaces S2 are formed between the heat exchanging portion 1D3 and the heat exchanging portion 1D2. The heat exchanging portion 1D4 forming the other part of the second heat exchanging body 20D is arranged such that the spaces S3 larger than the spaces S2 are formed between the heat exchanging portion 1D4 and the heat exchanging portion 1D3.

The first heat exchanging body 10D is not limited to the structure in which two flat tubes 1*a* (two heat exchanging portions 1D) are coupled with each other and may include three or more flat tubes 1*a* (three or more heat exchanging portions 1D) that are coupled with each other.

Effects of Third Modification

The heat exchanger 100 according to the third modification includes the first heat exchanging body 10D including the first flat tube P1 and the third flat tube P3 that are coupled with each other and the second flat tube P2 and the fourth flat tube P4 that are coupled with each other, and the second heat exchanging body 20D that is arranged downstream of the first heat exchanging body 10D in the direction of the flow of the fluid and that includes the first flat tube P1 and the third flat tube P3 that are separate from each other and the second flat tube P2 and the fourth flat tube P4 that are separate from each other. The effects of the heat exchanger 100 according to Embodiment and the effects of the heat exchanger 100 according to the second modification are thus achieved.

The spaces S2 may be formed between the first heat exchanging body 10D and the second heat exchanging body 20D. The spaces S3 larger than the spaces S2 may be formed between the heat exchanging portion 1D3 and the heat exchanging portion 1D4 of the second heat exchanging body 20D. This enables the airflow resistance on the downstream side in the direction of airflow to be decreased.

In the above heat exchanger 100 according to Embodiment and the above heat exchanger 100 according to the first modification to the third modification, the heat exchanging portions are arranged such that all the adjacent heat exchanging portions are oriented crosswise. The heat exchanger 100, however, is not limited thereto.

The heat exchanger 100 may include two heat exchanging portions that are not oriented crosswise.

The invention claimed is:

1. A heat exchanger comprising:

a plurality of heat exchanging bodies including a first heat exchanging body and a second heat exchanging body, the first and second heat exchanging bodies each including a first heat exchanging portion including first and second flat tubes stacked in parallel with each other to allow fluid to pass between the first and second flat tubes; and a second heat exchanging portion including third and fourth flat tubes stacked in parallel with each other to allow fluid to pass between the third and fourth flat tubes, the second heat exchanging body being arranged downstream of the first heat exchanging body in a direction of the flow of the fluid, the first and second flat tubes of the first heat exchanging body, the third and fourth flat tubes of the first heat exchanging body, the first and second flat tubes of the second heat exchanging body, and the third and fourth flat tubes of the second heat exchanging body are arranged in that order in the direction of the flow of the fluid, the first heat exchanging body and the second heat exchanging body being configured such that the third flat tube of the second heat exchanging portion is oriented crosswise to the first flat tube of the first heat exchanging portion in a cross-section perpendicular to a longitudinal direction of the third flat tube, the fourth flat tube of the second heat exchanging portion is oriented crosswise to the second flat tube of the first heat exchanging portion in a cross-section perpendicular to a longitudinal direction of the fourth flat tube, wherein lengths of the first and second flat tubes of the second heat exchanging body in a transverse direction to a direction of fluid flow paths in the first and second flat tubes are larger than lengths of the first and second flat tubes of the first heat exchanging body in the transverse direction, wherein an angle formed between the first flat tube of the first heat exchanging body and the direction of the flow of the fluid is larger than an angle formed between the first flat tube of the second heat exchanging body and the direction of the flow of the fluid, wherein lengths of the third and fourth flat tubes of the second heat exchanging body in the transverse direction are larger than lengths of the third and fourth flat tubes of the first heat exchanging body in the transverse direction, and wherein an angle formed between the third flat tube of the first heat exchanging body and the direction of the flow of the fluid is larger than an angle formed between the third flat tube of the second heat exchanging body and the direction of the flow of the fluid.

2. The heat exchanger of claim 1, wherein the first heat exchanging body and the second heat exchanging body are configured such that the first and third flat tubes are coupled with each other, and the second and fourth flat tubes are coupled with each other.

3. The heat exchanger of claim 1, wherein the first heat exchanging body and the second heat exchanging body are configured such that the first and third flat tubes are separate from each other, and the second and fourth flat tubes are separate from each other.

4. The heat exchanger of claim 3, wherein the first heat exchanging body is configured such that a first space is formed between the first and third flat tubes and between the second and fourth flat tubes, and the second heat exchanging body is configured such that a second space is formed between the first and third flat tubes and between the second and fourth flat tubes.

5. The heat exchanger of claim 4, wherein a third space is formed between the third flat tube of the first heat exchanging body and the first flat tube of the second heat exchanging body and between the fourth flat tube of the first heat exchanging body and the second flat tube of the second heat exchanging body, wherein the first space is larger than the third space, and the third space is larger than the second space.

6. The heat exchanger of claim 1, wherein in the first heat exchanging body, the first and third flat tubes are coupled with each other and the second and fourth flat tubes are coupled with each other, and in the second heat exchanging body, the first and third flat tubes are separate from each other and the second and fourth flat tubes are separate from each other.

7. The heat exchanger of claim 1, wherein the first heat exchanging body and the second heat exchanging body are configured such that the first flat tube, the second flat tube, the third flat tube, and the fourth flat tube include no fin.

8. A refrigeration cycle apparatus comprising the heat exchanger of claim 1, wherein the heat exchanging portions are oriented in parallel with a gravity direction.

* * * * *